US007346298B2

(12) United States Patent
Yamaguchi et al.

(10) Patent No.: US 7,346,298 B2
(45) Date of Patent: Mar. 18, 2008

(54) DEVELOPING DEVICE, PROCESS CARTRIDGE, AND ELECTROPHOTOGRAPHIC IMAGE-FORMING APPARATUS

(75) Inventors: Seiji Yamaguchi, Mishima (JP); Tachio Kawai, Odawara (JP); Syuhei Kawasaki, Susono (JP); Issei Imamura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 11/093,058

(22) Filed: Mar. 29, 2005

(65) Prior Publication Data

US 2006/0045573 A1 Mar. 2, 2006

(30) Foreign Application Priority Data

Aug. 30, 2004 (JP) ..... 2004-250266
Feb. 24, 2005 (JP) ..... 2005-049029

(51) Int. Cl.
*G03G 15/08* (2006.01)

(52) U.S. Cl. ..... 399/256

(58) Field of Classification Search ..... 299/254–256
See application file for complete search history.

(56) References Cited

U.S. PATENT DOCUMENTS 5,963,766 A * 10/1999 Okuno et al. ..... 399/256
6,122,472 A * 9/2000 Sako et al. ..... 399/254
2002/0051657 A1* 5/2002 Yuuki et al. ..... 399/254

FOREIGN PATENT DOCUMENTS

JP 59053868 A * 3/1984
JP 4-39073 A 2/1992
JP 8-30084 A 2/1996
JP 10-142942 A 5/1998

* cited by examiner

*Primary Examiner*—David M. Gray
*Assistant Examiner*—Ryan Gleitz
(74) *Attorney, Agent, or Firm*—Canon U.S.A. Inc I.P. Div

(57) ABSTRACT

A developing device includes a developer container divided into a developing section and a mixing section in which developer is conveyed in the opposite directions. A conveying member which conveys the developer in the longitudinal direction is disposed only in the developing section, and a mixing member which does not positively convey the developer in the longitudinal direction is disposed in the mixing section.

24 Claims, 14 Drawing Sheets

DEVELOPING DEVICE, PROCESS CARTRIDGE, AND ELECTROPHOTOGRAPHIC IMAGE-FORMING APPARATUS

BACKGROUND OF THE INVENTION

1. Field of the Invention

The present invention relates to a developing device, a process cartridge, and an electrophotographic image-forming apparatus.

2. Description of the Related Art

In a typical electrophotographic image-forming apparatus, a developer supply method is used in which developer is added as it is consumed. In a typical developer supply method, developer is supplied by replacing a developer container which is detachably attached to the electrophotographic image-forming apparatus with another one. For example, Japanese Patent Laid-Open No. 8-30084 discloses a developer container including a developer circulation path for making developer contained in the developer container and newly supplied developer uniform before they reach a developing member. In addition, instead of the structure in which two screws are arranged adjacent to each other so that the developer is circulated horizontally, a structure in which two screws are vertically arranged so that the developer is circulated vertically may also be applied, as disclosed in Japanese Patent Publication No. 4-39073 and Japanese Patent Laid-Open No. 10-142942.

However, in the above-described developing device having a structure for circulation, the following points must be considered.

That is, developer in the developing device becomes gradually degraded as it is circulated multiple times in the developing device. This is because resin contained in the developer becomes abraded or deformed by being mechanically rubbed in the developing device. In addition, external additive applied to the surface becomes separated or embedded into the resin. Thus, developer contained in the developing device becomes gradually degraded. Therefore, characteristics, such as charging characteristics, of the degraded developer and those of new developer are different from each other. If the degraded developer and newly supplied developer are conveyed to the developing member while they are unevenly distributed, uneven density or fog appears on an image due to differences in the amount of charge between the new and old developers. Accordingly, the new and old developers must be mixed uniformly at least before they are fed to the developing member.

SUMMARY OF THE INVENTION

The present invention is directed to a developing device, a cartridge, and an electrophotographic image-forming apparatus in which a sufficient amount of developer is fed to a developing member and developer supplied by a developer supplier is sufficiently mixed.

In addition, the present invention is also directed to a developing device, a process cartridge, and an electrophotographic image-forming apparatus in which developer supplied by a developer supplier and developer contained in the developing device are uniformly mixed with each other.

According to one aspect of the present invention, a developing device used in an electrophotographic image-forming apparatus includes a developing member for developing an electrostatic latent image formed on an electrophotographic photosensitive member with developer; a first container section which contains developer to be fed to the developing member; a second container section positioned above the first container section in a state in which the developing device is installed in the electrophotographic image-forming apparatus, the second container section containing developer supplied from a developer supplier to feed developer to the first container section and being connected to the first container section through a first opening and a second opening; a first developer-conveying member disposed in the first container section, the first developer-conveying member feeding developer to the developing member and conveying developer from the first opening to the second opening in the first container section; and a second developer-conveying member disposed in the second container section, the second developer-conveying member conveying developer from the second opening to the first opening in the second container section. A developer-conveying force of the second developer-conveying member which conveys developer from the second opening to the first opening in the second container section is weaker than a developer-conveying force of the first developer-conveying member which conveys developer from the first opening to the second opening in the first container section.

Accordingly, the present invention provides a developing device, a cartridge, and an electrophotographic image-forming apparatus in which a sufficient amount of developer is supplied to a developing member and developer supplied by a developer supplier is sufficiently mixed.

In addition, the present invention also provides a developing device, a process cartridge, and an electrophotographic image-forming apparatus in which developer supplied by a developer supplier and developer contained in the developing device are uniformly mixed.

Further features and advantages of the present invention will become apparent from the following description of exemplary embodiments with reference to the attached drawings.

DESCRIPTION OF THE EMBODIMENTS

First Embodiment

Figure 1:
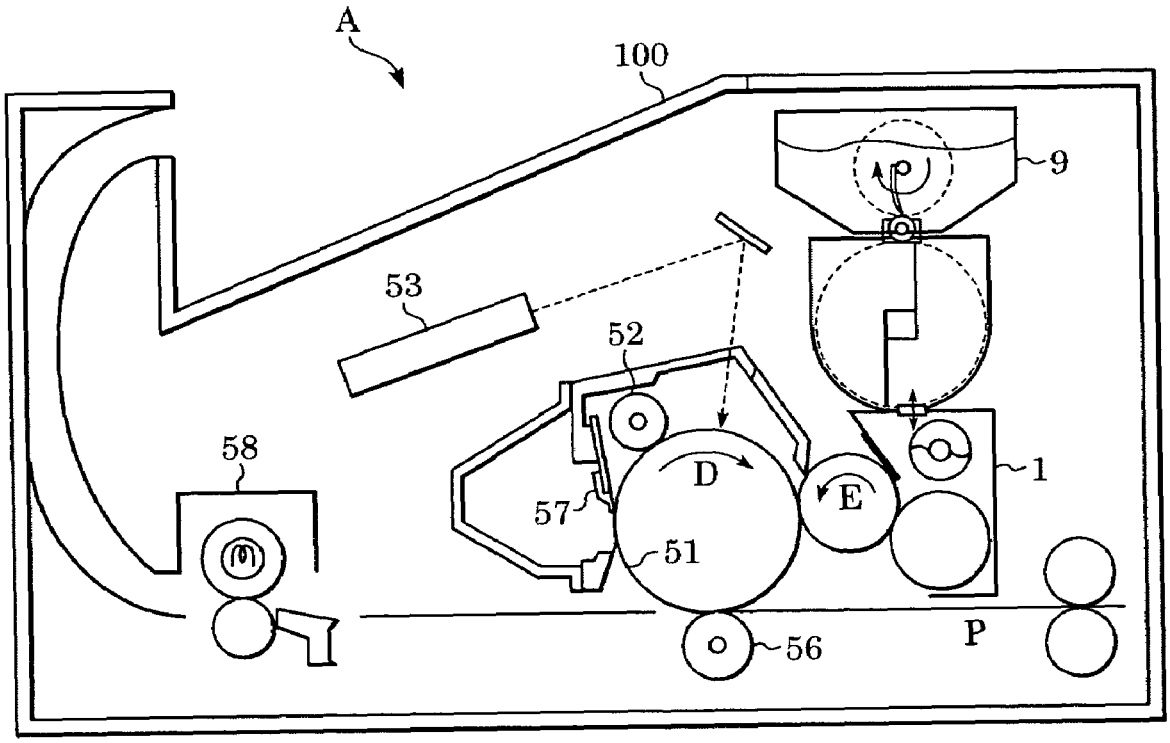
FIG. 1 is a schematic diagram showing an electrophotographic image-forming apparatus according to a first embodiment.
Figure 2:
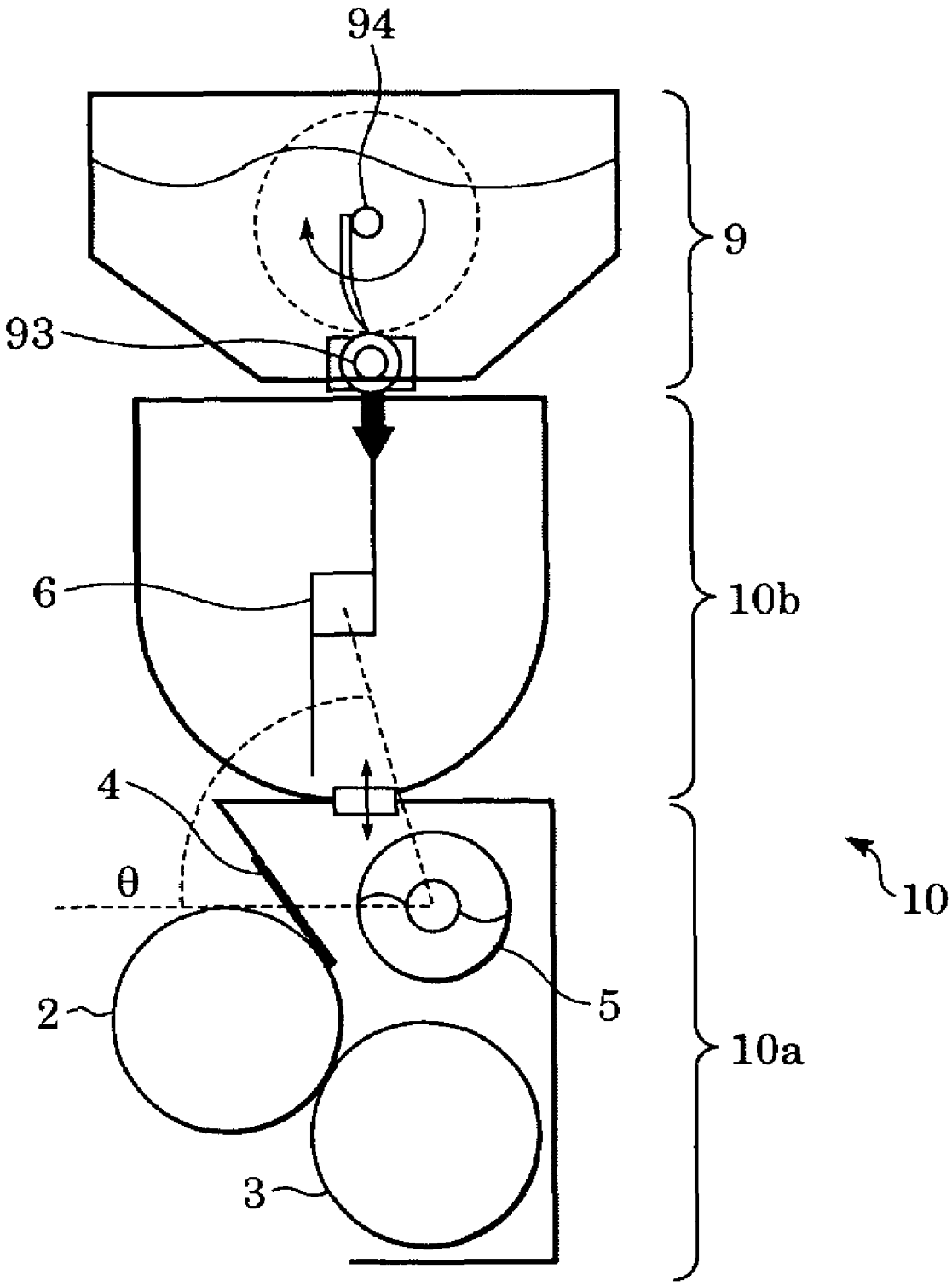
FIG. 2 a schematic diagram showing a developing device and a developer hopper according to the first embodiment.

FIG. 1 shows the structure of an electrophotographic image-forming apparatus according to a first embodiment of the present invention. FIG. 2 shows the structure of a developing device used in the electrophotographic image-forming apparatus according to the first embodiment of the present invention.

A drum-shaped electrophotographic photosensitive member (hereafter called a photosensitive drum 51) is supported at a substantially central area of an electrophotographic image-forming apparatus A in such a manner that the photosensitive drum 51 can rotate in a direction shown by the arrow D in FIG. 1. When an image-forming operation starts, the photosensitive drum 51 is uniformly charged by a charging member 52. Then, the photosensitive drum 51 is exposed in accordance with image information by a laser radiator 53, which functions as an exposing unit. Accordingly, an electrostatic latent image is formed on the photosensitive drum 51.

Then, the electrostatic latent image is developed with developer by a developing device 1, and a developer image is formed on the photosensitive drum 51. Then, the developer image is electrostatically transferred onto a recording medium P in a transfer electric field generated between a transfer roller 56, which functions as a transferring member, and the photosensitive drum 51. Then, a fixing device 58 fixes the developer image on the recording medium P by applying heat and pressure. After the developer image is transferred, developer remaining on the photosensitive drum 51 is removed by a cleaning device 57 including a blade-shaped cleaning member. Accordingly, the photosensitive drum 51 is made ready for forming the next image.

The developer used in the present embodiment is a negative electric, nonmagnetic, one-component developer. In addition, a process speed of the image-forming apparatus A according to the present embodiment, that is, the peripheral speed of the photosensitive drum 51 is 150 mm/sec, and the corresponding peripheral speed of a developer roller 2 is 225 mm/sec.

A developer container 10 has an opening at the side facing the photosensitive drum 51, and a part of the developer roller 2, which functions as a developing member, projects from this opening. The developer roller 2 is supported by the developer container 10 in such a manner that the developer roller 2 can rotate in a direction shown by the arrow E in FIG. 2. The developer roller 2 is made of low-hardness rubber material, foam material, or a combination thereof, such as silicone and urethane, in which a conductive agent, such as carbon, is dispersed and which has a volume resistivity in the range of $10^2$ Ωcm to $10^{10}$ Ωcm. The developer roller 2 is a semiconductive, elastic roller with an outer diameter of 20 mm. The developer roller 2 includes an elastic body, and is in pressure contact with the photosensitive drum 51 at a predetermined contact pressure. A feeding roller 3 which feeds the developer to the developer roller 2 and removes and collects the developer from the developer roller 2 is an insulative sponge roller with an outer diameter of 16 mm which includes an elastic body. The feeding roller 3 is in contact with the developer roller 2.

The developer container 10 includes a developer blade 4 which functions as a developer-layer regulating member. The blade 4 is a leaf spring made of stainless steel, and is in contact with the developer roller 2 at a predetermined contact pressure.

The blade 4 regulates the thickness of a layer of developer fed to the developer roller 2. As a result, the developer fed to the developer roller 2 is electrically charged. Then, a thin developer layer on the peripheral surface of the developer roller 2 is fed to a developing area. More specifically, the developer roller 2 develops the electrostatic latent image formed on the photosensitive drum 51 with the developer. Developer which does not contribute to the developing process and remains on the developer roller 2 is removed from the peripheral surface of the developer roller 2 when the feeding roller 3 slides on the developer roller 2. Then, the developer removed from the peripheral surface of the developer roller 2 is fed to the photosensitive drum 51 by the developer roller 2 together with the developer newly fed by the feeding roller 3. Then, developer which is not fed to the photosensitive drum 51 and remains on the developer roller 2 returns to the developer container 10. Although the feeding roller 3 functions as both a developer feeder and a developer collector in the present embodiment, the present invention is not limited to this. For example, a developer feeder and a developer collector may also be provided separately.

Figure 3:
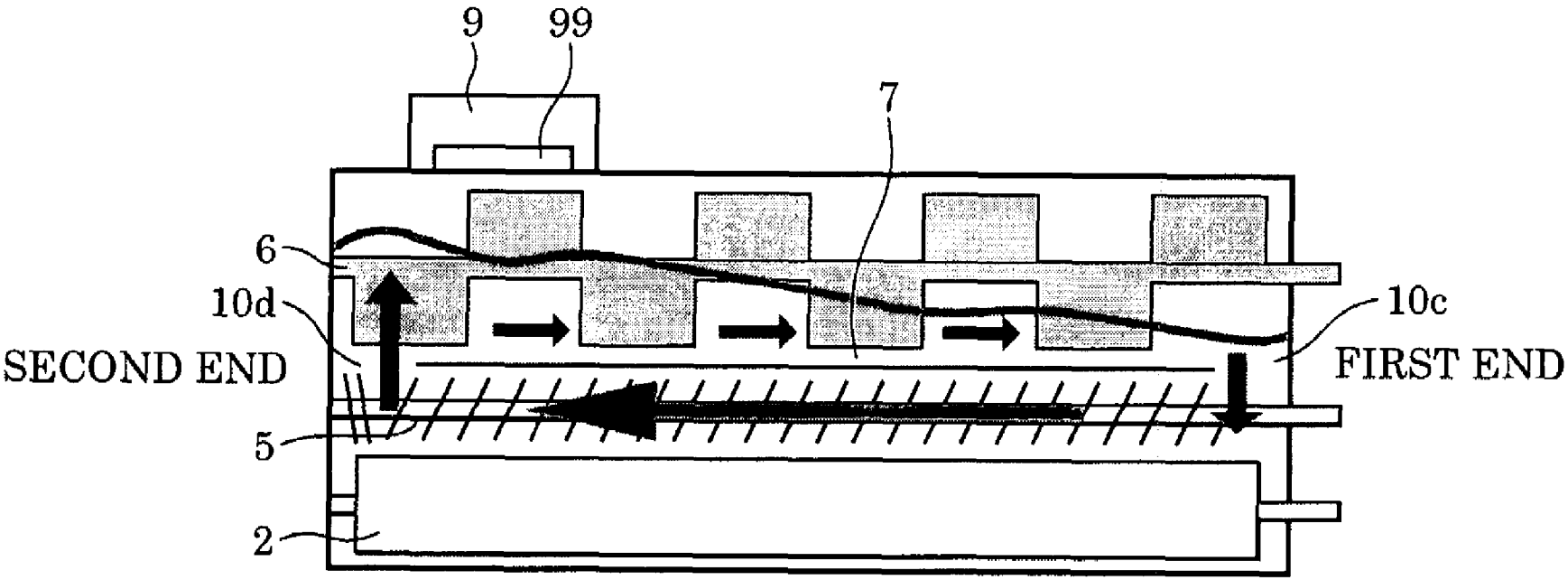
FIG. 3 is a schematic diagram showing a vertical view of the developing device according to the first embodiment.
Figure 4A:
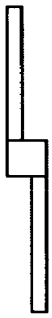
FIGS. 4A and 4B are schematic diagrams showing a mixing member according to the first embodiment.
Figure 4B:
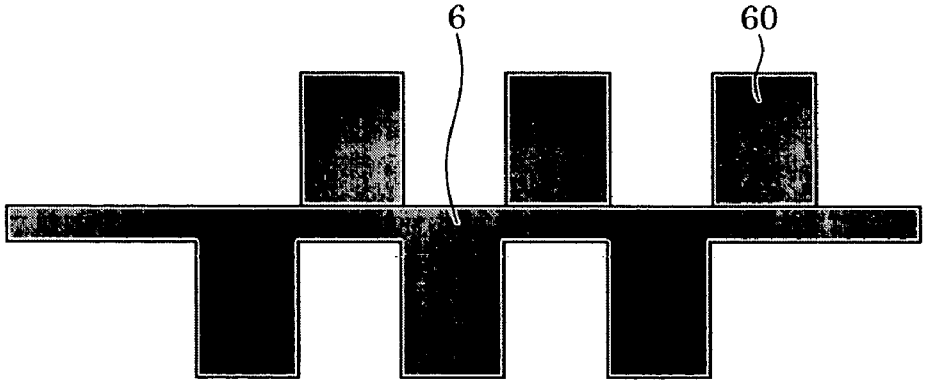
Figure 5A:
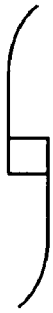
FIGS. 5A and 5B are schematic diagrams showing a modification of the mixing member according to the first embodiment.
Figure 5B:
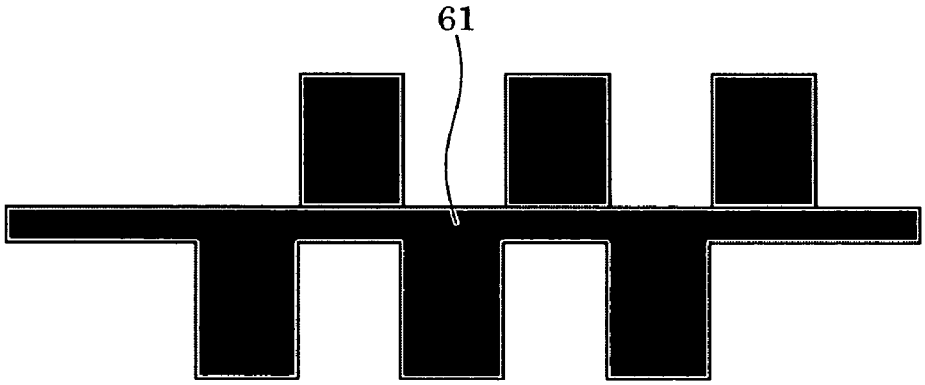

FIG. 3 is a schematic diagram showing the developing device according to the first embodiment of the present invention viewed from the side (from the right in FIG. 2). FIG. 4A is a schematic diagram showing a mixing member 6 disposed in a mixing section viewed in the longitudinal direction, and FIG. 4B is a schematic diagram showing the mixing member 6 viewed from the side.

The developer container 10 is divided into upper and lower sections by a dividing wall 7, the two sections extending in the longitudinal direction of the developer container 10. The lower section of the developer container 10 in the state in which the developer container 10 is attached to a main body 100 of the apparatus is called a first container section, and the upper section is called a second container section. A developing section 10*a*, which defines the first container section, includes the developer roller 2, which functions as a developing member, and a screw 5, which functions as a developer-conveying member. The developing section 10*a* accommodates developer to be fed to the developer roller 2. A mixing section 10*b*, which defines the second container section, includes the mixing member 6. The mixing section 10*b* accommodates developer to be fed to the developing section 10*a*. The mixing section 10*b* receives developer from a developer hopper 9, which functions as a developer supplier. The developing section 10*a* and the mixing section 10*b* are linked with each other via openings formed at ends of the developer roller 2 in the longitudinal direction thereof. In other words, the developing section 10*a* and the mixing section 10*b* are connected to each other (communicates with each other) at first and second ends of the developer roller 2 in the longitudinal direction thereof.

The screw 5, which functions as a developer-conveying member, is disposed in the developing section 10*a*. The screw 5 conveys the developer contained in the developing section 10*a* in the longitudinal direction thereof. More specifically, the screw 5 conveys developer which falls down from a first opening 10*c* formed at the first end of the screw 5 in the longitudinal direction toward the central area of the developing section 10*a* in the longitudinal direction thereof. Thus, the screw 5 conveys the developer contained in the developing section 10*a* to a second opening 10*d* formed at the second end of the screw 5. Then, the screw 5 pushes the developer up into the mixing section 10*b* through the second opening 10*d*. In addition, the screw 5 feeds the developer to the developer roller 2 in the developing section 10*a*.

The mixing member 6, which functions as a developer mixing member, is disposed in the mixing section 10*b*. The mixing member 6 includes a plurality of blades. As the blades 60 rotate, the adjacent blades 60 alternatively pushes the developer upward and thereby mix the developer.

The screw 5 and the mixing member 6 are connected to the developer roller 2 and the feeding roller 3 with gears (not shown). In addition, the screw 5 and the mixing member 6 rotate while an image-forming operation is being performed, that is, while the developer roller 2 is rotating, and stop rotating when the image-forming operation finishes.

The developer hopper 9 includes a breaking member 94 and a supply roller 93. The breaking member 94 breaks the developer in the developer hopper 9 and the supply roller 93 supplies the developer in the developer hopper 9 to the mixing section 10*b*. The supply roller 93 rotates in response to a supply command transmitted from the main body 100 of the apparatus. The supply roller 93 supplies a certain amount of developer to the mixing section 10*b* per predetermined time. Accordingly, the amount of developer in the developer container 10 is maintained constant. In order to determine the amount of developer to be supplied by transmitting the supply command, a method may be used in which a piezoelectric sensor (not shown) is provided in the developer container 10 to detect the presence/absence of the developer. Alternatively, an optical detection method, an inductance detection method, a method of calculating the amount of developer consumed on the basis of a print rate of an image. In the present embodiment, an optical detection sensor (not shown) for detecting the amount of developer is provided in the mixing section 10*b*. When this sensor detects that the amount of developer is small, the supply roller 93 rotates and supplies developer in the developer hopper 9 to the mixing section 10*b*.

Next, circulation of the developer in the developing device according to the present embodiment will be described below.

The developer in the developing section 10*a* is conveyed from the first end to the second end in the longitudinal direction by the screw 5. Accordingly, a pressure is applied to the developer and the developer is pushed into the mixing section 10*b* from the developing section 10*a* through the second opening 10*d*. A supply opening 99 is formed in the mixing section 10*b* at the second end of the mixing section 10*b*, and developer is supplied from the developer hopper 9 through the supply opening 99. Accordingly, the developer conveyed from the developing section 10*a* by the screw 5 and the developer supplied from the developer hopper 9 are sufficiently mixed while they are conveyed from the second end to the first end in the mixing section 10*b*.

The mixing member 6 levels the developer horizontally by rotating the blades 60, but does not have further conveying ability. In other words, a developer conveying force of the mixing member 6 in the longitudinal direction is weaker than that of the developer-conveying member 5. In more detail, the mixing member 6 does not positively convey the developer toward the first end no manner how long the blades of the mixing member 6 is rotated. Instead, the mixing member 6 simply makes the height of the developer in the mixing section 10*b* uniform, and the developer in the mixing section 10*b* slowly moves from second end toward the first end as a result. The supplied developer and the developer from the developing section 10*a* are conveyed from the second end to the first end taking time enough for them to mix uniformly. Thus, conveying ability of the mixing member 6 in the longitudinal direction thereof can only level the developer horizontally in the mixing section 10*b*. Here, a conveying force which can only level the developer horizontally in the longitudinal direction will be explained in more detail below. First, Tests 1 to 3 were performed using members A to C under conditions described below, and Results 1 to 3 were respectively obtained.

Figure 11A:
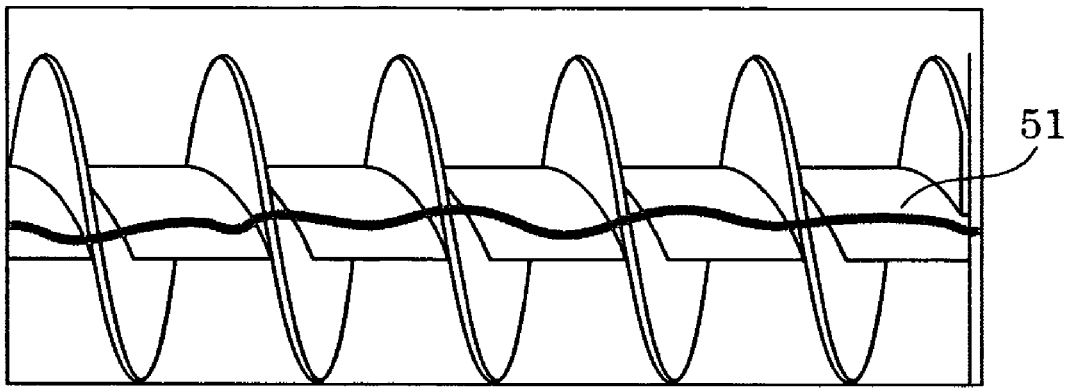
FIGS. 11A to 11C are schematic diagrams showing another modification of the mixing member according to the first embodiment.

The members used in Tests 1 to 3 were:

member A (FIGS. 11A to 11C): a screw member 51 (fin pitch 20 mm, longitudinal dimension 320 mm, and maximum outer diameter 30 mm);

member B (FIGS. 12A to 12C and FIGS. 5A and 5B): a member 61 in which Mylar (trademark) blades with a width of 20 mm were alternately arranged in the longitudinal direction (longitudinal dimension 320 mm and maximum outer diameter 30 mm); and member C (FIGS. 13A to 13C and FIG. 10A and 10B): a member 66 in which four springs 4 were supported rotatably (longitudinal dimension 320 mm and maximum outer diameter 30 mm)

Test 1

The openings at the ends of the first and second container sections shown in FIGS. 2 and 3 were closed and only the second container section was used. First, the developer was leveled horizontally at the height of the mixing center (FIGS. 11A, 12A, and 13A), and the members A to C were rotated for 30 minutes. Then, the state of the developer in the longitudinal direction was observed for each of the members A and C.

Result 1

Figure 11B:
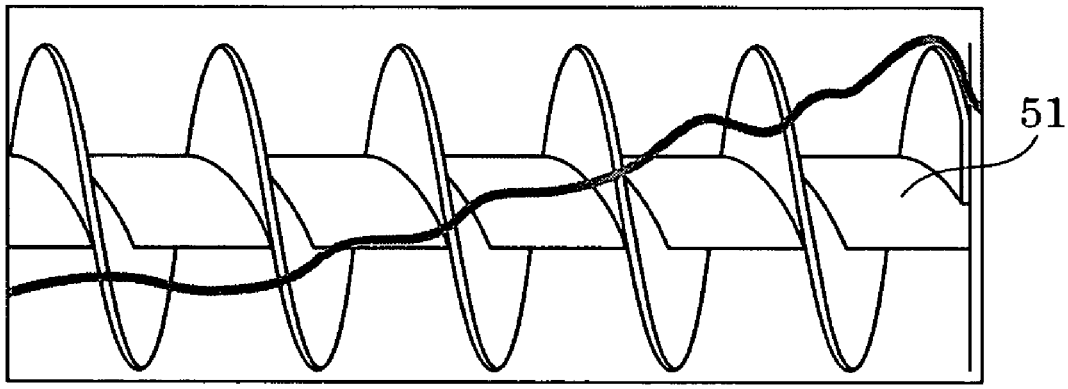
Figure 13A:
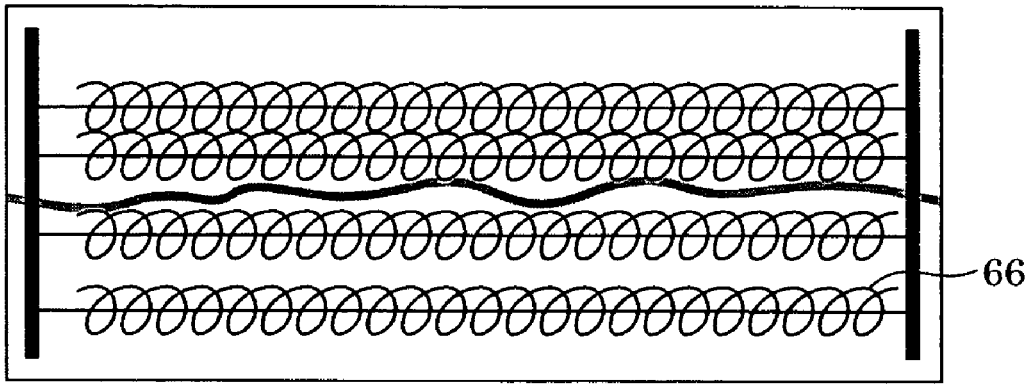
FIGS. 13A to 13C are schematic diagrams showing another modification of the mixing member according to the first embodiment.

The following results were obtained from Test 1:

member A: the developer collected at the first end in the longitudinal direction (FIG. 11B);

member B: the developer maintained leveled in the horizontal direction (FIG. 12A); and member C: the developer maintained leveled in the horizontal direction (FIG. 13A).

Test 2

Figure 11C:
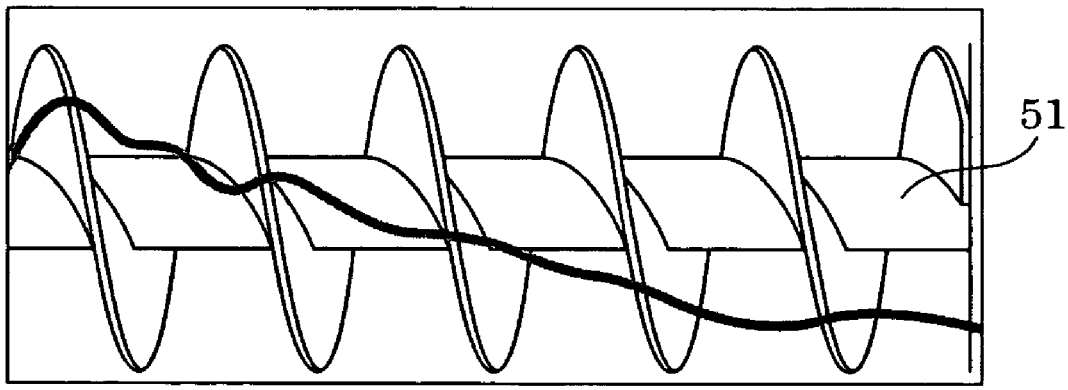
Figure 12A:
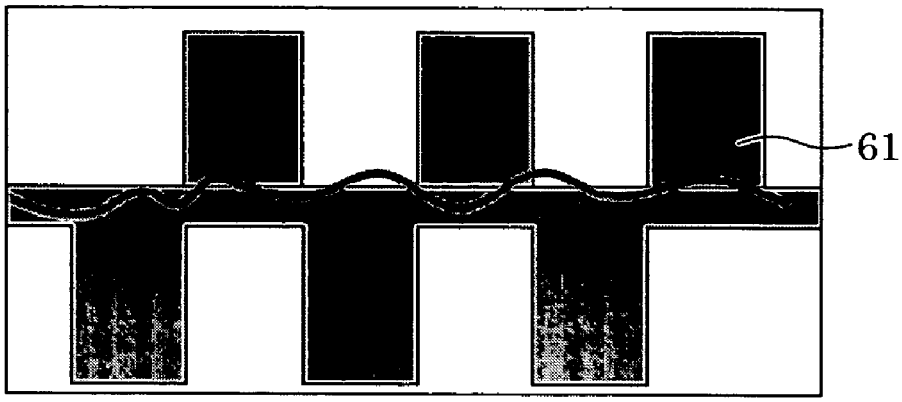
FIGS. 12A to 12C are schematic diagrams showing another modification of the mixing member according to the first embodiment.
Figure 12B:
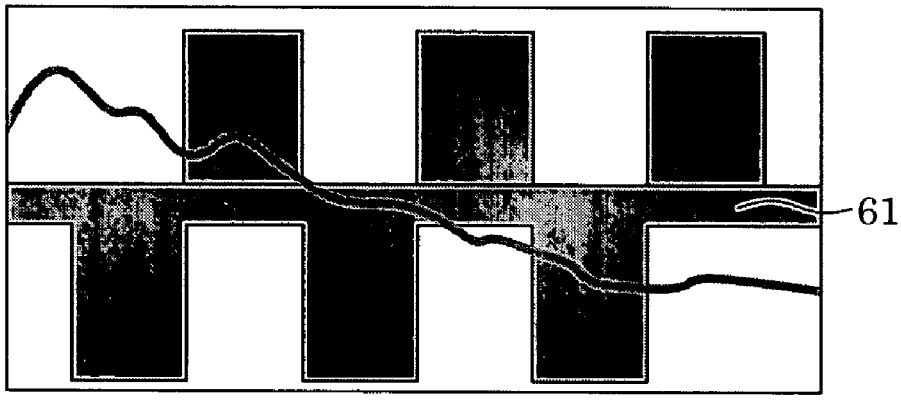
Figure 13B:
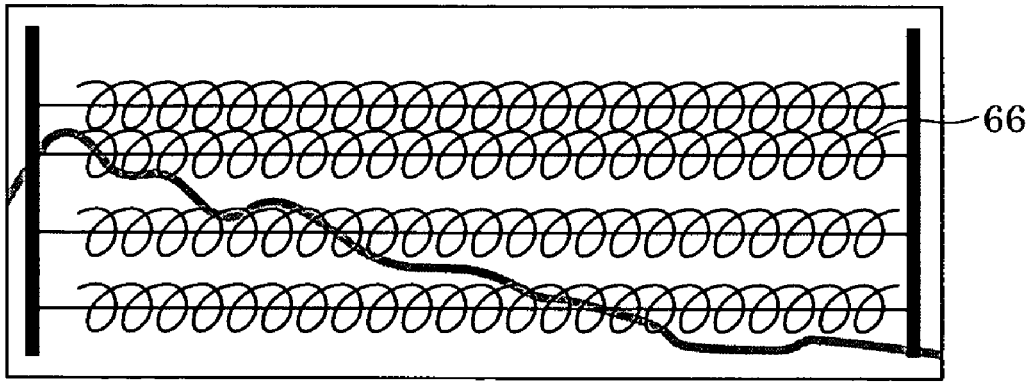

Similar to Test 1, the openings at the ends of the first and second container sections were closed and only the second container section was used. First, the developer was put into the second container section by an amount such that the developer can be leveled horizontally at the height of the mixing center, and the developer was collected at the second end in the longitudinal direction (FIGS. 11C, 12B, and 13B). Then, the members A to C were rotated at 100 rpm for 30 minutes, and the state of the developer in the longitudinal direction was observed for each of the members A and C.

Result 2

The following results were obtained from Test 2:

member A: the developer collected at the first end in the longitudinal direction (FIG. 11B);

member B: the developer became leveled in the horizontal direction (FIG. 12A); and member C: the developer became leveled in the horizontal direction (FIG. 13A).

Test 3

Figure 12C:
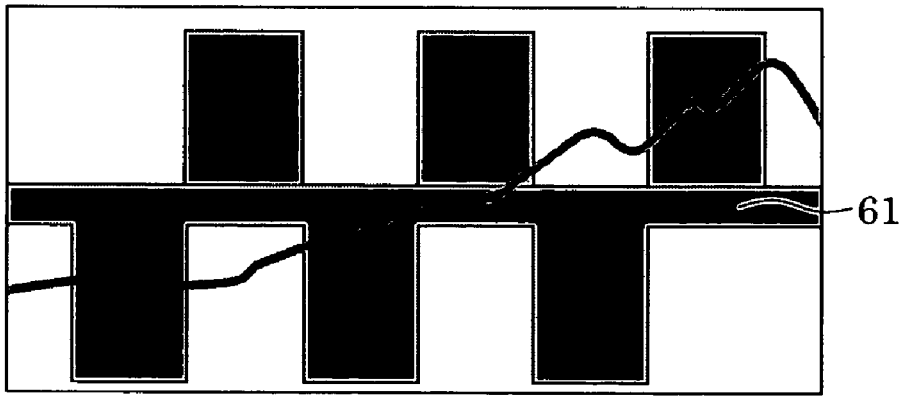
Figure 13C:
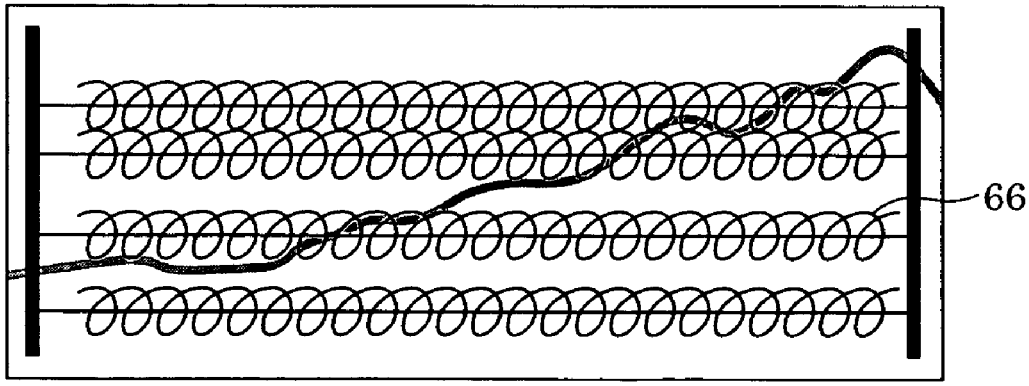

Similar to Test 1, the openings at the ends of the first and second container sections were closed and only the second container section was used. First, the developer was put into the second container section by an amount such that the developer can be leveled horizontally at the height of the mixing center, and the developer was collected at the first end in the longitudinal direction (FIGS. 11B, 12C, and 13C). Then, the members A to C were rotated at 100 rpm for 30 minutes, and the state of the developer in the longitudinal direction was observed for each of the members A and C.

Result 3

The following results were obtained from Test 3:

member A: the developer maintained collected at the first end in the longitudinal direction (FIG. 11B);

member B: the developer became leveled in the horizontal direction (FIG. 12A); and member C: the developer became leveled in the horizontal direction (FIG. 13A).

With reference to Tests 1 to 3 and Results 1 to 3, "a conveying force large which can only level the developer horizontally in the longitudinal direction" refers to a force which satisfies the following two conditions: 1) developer which is leveled horizontally cannot be collected at the first (or second) end in the longitudinal direction, and 2) developer collecting at the first (or second) end in the longitudinal direction can be leveled horizontally, but developer leveled horizontally cannot be collected at the second (or first) end in the longitudinal direction.

Next, the behavior of developer in the mixing section 10*b* according to the present embodiment will be described below. Developer conveyed through the second opening 10*d* and newly supplied developer swell upward in the mixing section 10*b*. Then, the mixing member 6 makes the swelling developer horizontally uniform. By continuously leveling the swelling developer horizontally, the developer gradually spreads in the mixing section 10*b*. As a result, the developer reaches the first opening 10*c*. Then, the developer falls from the mixing section 10*b* into the developing section 10*a* through the first opening 10*c*. Then, the developer is conveyed by the screw 5 toward the central area of the developing section 10*a* in the longitudinal direction thereof, and is supplied to the developer roller 2 at the same time.

Accordingly, in the present embodiment, a conveyance path for the developer in the developer container 10 is structured such that the developer can freely move between the developing section 10*a* and the mixing section 10*b*. However, the developing device 1 according to the present embodiment is different from a known electrophotographic image-forming apparatus in which two screws are provided. More specifically, as described above, the conveying force of the mixing member 6 in the longitudinal direction can only level the developer horizontally in the longitudinal direction. In this case, unlike the structure in which each of the container sections has a screw, the developer stays in the mixing section 10*b* for a time long enough to uniformly mix the developer. Accordingly, the process of mixing the developer newly supplied to the mixing section 10*b* and the developer contained in the developer container 10 is performed for a long time. As a result, the developer contained in the developer container 10 and the developer newly supplied to the developer container 10 are sufficiently mixed with each other when they are fed to the developer roller 2. Accordingly, problems caused when the developer is not mixed enough, such as uneven density and fog, are avoided.

In addition, in the structure according to the present embodiment, the circulation rate of the developer in the developing device 1 is determined only by the screw 5. Therefore, the overall circulation rate can be easily set to a desired value by adjusting the outer diameter, a pitch of the helical blade, the rotational speed, etc., of the screw 5. Accordingly, unlike the known structure including two screws, it is not necessary to balance the flow rates of the two screws. As a result, stable circulation of the developer performed in the developer container 10 can be performed continuously.

The time for which the developer stays in the mixing section 10*b* depends on the developer conveying ability of the screw 5 and the volume of the developer in the mixing section 10*b*. Therefore, the time for which the developer stays in the mixing section 10*b* can be increased by increasing the amount of developer in the mixing section 10*b*. The amount of developer contained in the mixing section 10*b* may be twice or more the amount of developer contained in the developing section 10*a*. Accordingly, the time required for the developer to pass through the mixing section 10*b* is twice or more the time required for the developer to pass through the developing section 10*a*. Therefore, a sufficiently long mixing time can be obtained. The time for which the developer stays in the mixing section 10*b* can also be increased by increasing the capacity of the mixing section 10*b*. In the present embodiment, the conveying (circulation) speed of the developer in the developer container 10 is about 20 g/min. In addition, the amount of developer in the developing section 10*a* is 30 g, and the amount of developer in the mixing section 10*b* is set within the range of 60 g to 100 g. Since the developing section 10*a* is always filled with the developer, the amount of developer in the developing section 10*a* is constant. In comparison, the amount of developer in the mixing section 10*b* is reduced by the amount fed to the developer roller 2, and is increased by the amount supplied from the hopper 9. Therefore, the amount of developer in the mixing section 10*b* varies within the range of 60 g and 100 g. The time required for the developer to pass through the developing section 10*a* is about 1.5 minutes, and the time required for the developer to pass through the mixing section 10*b* is in the range of 3 to 5 minutes. In the present embodiment, the time for which the developer is mixed in the mixing section 10*b* increases as the amount of developer in the mixing section 10*b* increases. More specifically, when there is a large amount of developer in the mixing section 10*b*, the mixing time of the developer in the mixing section 10*b* is automatically increased. Therefore, in a period immediately after the developer is supplied from the developer hopper 9, the developer in the mixing section 10*b* is mixed for a long time. Since the newly supplied developer and the developer contained in the developer container 10 are particularly unevenly distributed immediately after the developer is supplied from the developer holder 9, and therefore there is a large necessity for mixing them in this period.

In addition, although the structure in which the mixing section 10*b* is disposed directly above the developing section 10*a* is described in the present embodiment, the present invention is not limited to this. Since the mixing member 6 barely exerts a conveying force in the longitudinal direction, a pressure for conveying the developer to the developing section 10*a* is low. However, since the mixing section 10*b* is disposed directly above the developing section 10*a*, the developer can be efficiently conveyed to the developing section 10*a* using the weight of the developer. In the present embodiment, an angle θ between the horizontal line and a line connecting the centers of the screw 5 and the mixing member 6 in cross section perpendicular to the longitudinal direction of the developing device 1 may be 30 degrees or more, or 45 degrees or more. Accordingly, the developer can be easily fed to the developing section 10*a* even though the mixing member 6 disposed in the mixing section 10*b* barely exerts a developer-conveying force in the longitudinal direction (see FIG. 2). The developer roller 2 is positioned below the mixing section 10*b*. Accordingly, even if the amount developer in the mixing section 10*b* somewhat varies, the developer roller 2 is always filled with the developer. As a result, the image density can be maintained constant. The mixing section 10*b* is disposed directly above the developing section 10*a*. Thus, the area necessary for installing the developing device 1 can be reduced.

As described above, in the developing device according to the present embodiment, unlike the known device including two screws, the mixing member 6 in the mixing section 10*b* barely exerts a conveying force in the longitudinal direction. Therefore, although the path in the container is structured such that the developer can freely move between the developing section 10*a* and the mixing section 10*b*, the developer stays in the mixing section 10*b* for a time long enough to uniformly mix the developer. Accordingly, the process of mixing the developer newly supplied to the mixing section 10*b* and the developer contained in the developer container 10 is performed for a long time, and therefore the developer contained in the developer container 10 and the newly supplied developer are sufficiently mixed with each other when they are fed to the developer roller 2. Accordingly, problems caused when the developer is not mixed enough are avoided.

In addition, in the present embodiment, the circulation rate in the overall developing device 1 is determined by the screw 5 disposed in the developing section 10*a*. Accordingly, the overall circulation rate can be easily set to a desired value by adjusting the outer diameter, a pitch of the helical blade, the rotational speed, etc., of the screw 5. Therefore, unlike the known structure including two screws, it is not necessary to balance the flow rates of the two screws, and the circulation rate can be easily set to a desired value. In addition, even if the amount of developer or the fluidity thereof somewhat vary, there is no risk that the conveying force will become unbalanced between the developing section 10*a* and the mixing section 10*b*. Therefore, stable circulation of the developer can be performed continuously.

In addition, in the known structure in which the developer is circulated using two developer-conveying members (screws) which convey the developer in opposite directions, conveying forces generated by the developer-conveying members (screws) slightly vary depending on the fluidity of the developer or the amount of developer in each container section. Therefore, in the known structure, it is difficult to design a developing device which can maintain a certain circulation state. In comparison, according to the present embodiment, the circulation rate in the overall developing device 1 can be calculated from the screw 5 in the developing section 10*a*. Accordingly, the circulation rate in the overall developing device 1 can be easily set to a desired value by adjusting the conditions of the screw 5. Thus, according to the present embodiment, the newly supplied developer can be sufficiently mixed while the overall circulation rate necessary for supplying the developer to the developer roller 2 is ensured. In addition, according to the present embodiment, the developer contained in the developer container 10 and the developer newly supplied from the developer hopper 9 are sufficiently mixed with each other when they are fed to the developer roller 2, while the overall circulation rate necessary for supplying the developer to the developer roller 2 is ensured. In other words, according to the present embodiment, mixing and circulation of the developer are easily balanced.

Figure 6A:
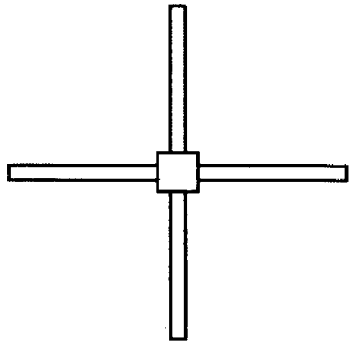
FIGS. 6A and 6B are schematic diagrams showing another modification of the mixing member according to the first embodiment.
Figure 6B:
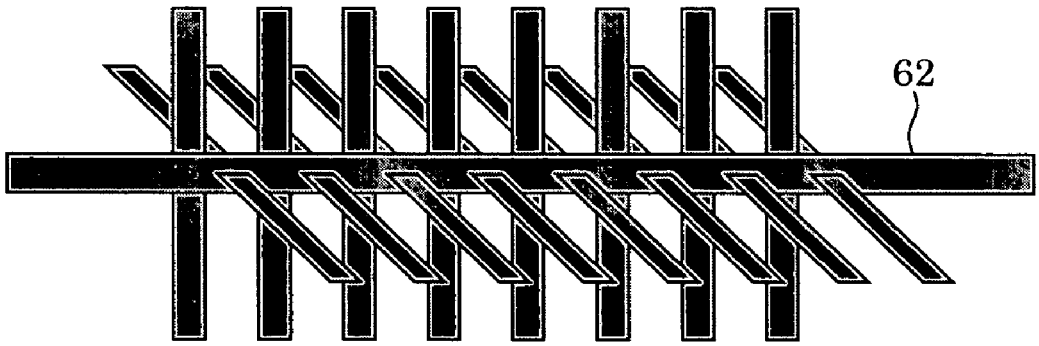
Figure 7:
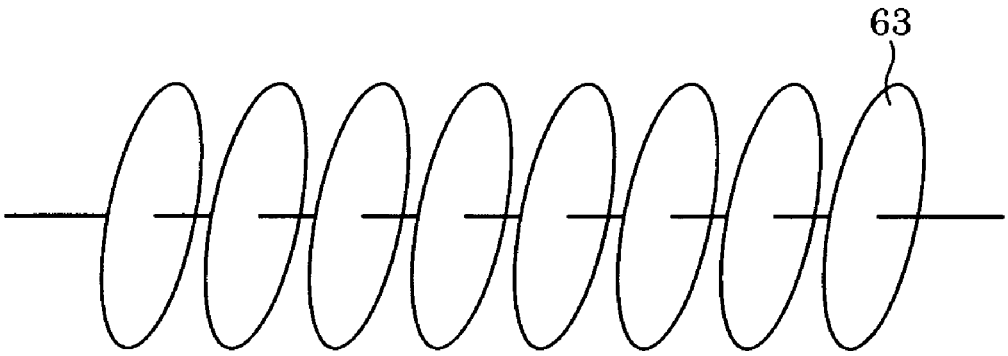
FIG. 7 is a schematic diagram showing another modification of the mixing member according to the first embodiment.
Figure 8:
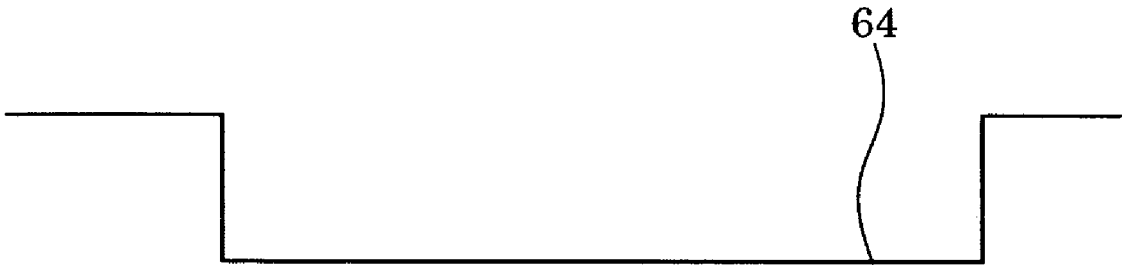
FIG. 8 is a schematic diagram showing another modification of the mixing member according to the first embodiment.
Figure 9:
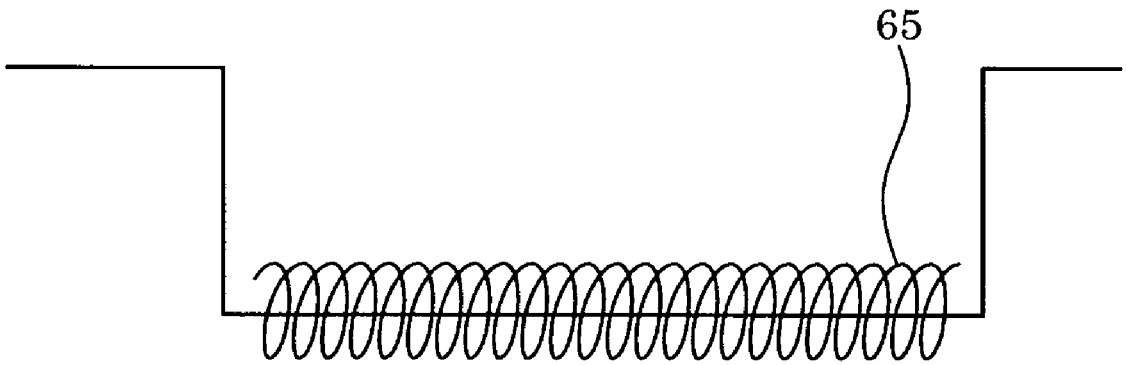
FIG. 9 is a schematic diagram showing another modification of the mixing member according to the first embodiment.
Figure 10B:
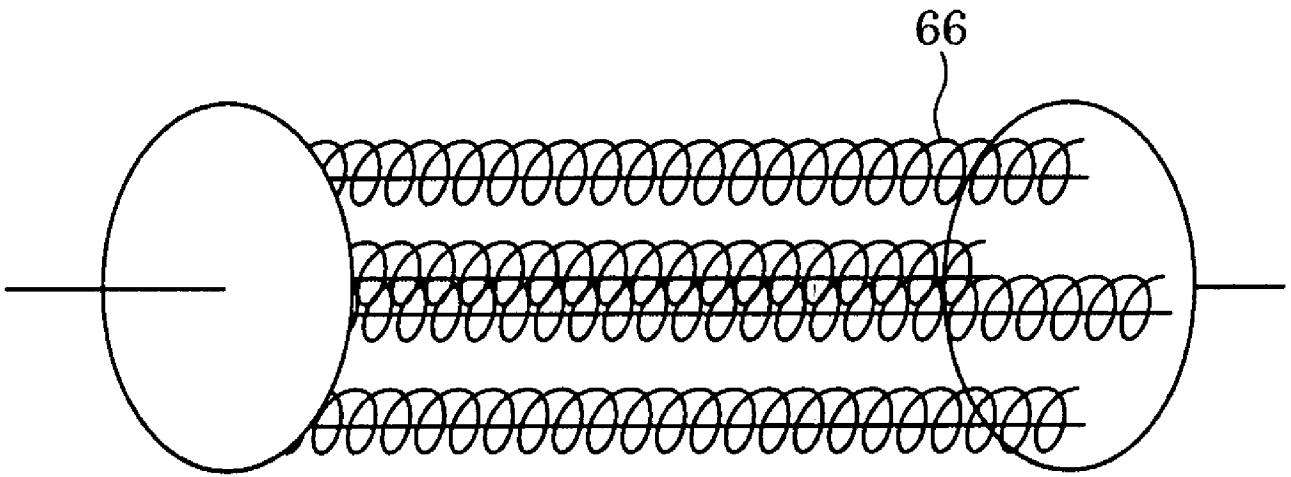
FIGS. 10A and 10B are schematic diagrams showing another modification of the mixing member according to the first embodiment.
Figure 10A:
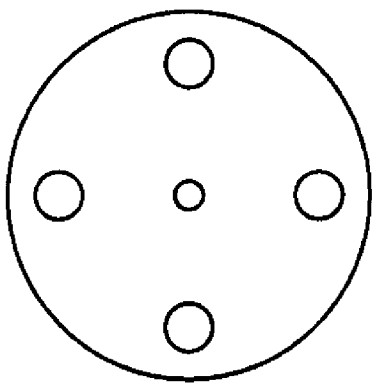

In the present embodiment, a rotating member to which a plurality of blades are attached is used as the mixing member 6 (FIGS. 4A and 4B). However, the mixing member 6 is not particularly limited to this structure as long as it is not capable of positively conveying the developer in the longitudinal direction but is capable of sufficiently mixing the developer in the circumferential direction. For example, a member 61 including a shaft and a plurality of plastic sheets attached to the shaft (FIGS. 5A and 5B and FIGS. 12A to 12C), a member 62 including a shaft and a plurality of sticks or ribs attached to the shaft (FIGS. 6A and 6B). In addition, a member 63 including a shaft and a plurality of oval plates attached to the shaft (FIG. 7), or a mixing stick 64 having a simple rectangular shape (FIG. 8) may also be used. In addition, a member 65 including a mixing stick having a simple rectangular shape and a coil spring wound around the mixing stick (FIG. 9) or a member 66 including a plurality of coil springs (FIGS. 10A and 10B and FIGS. 13A to 13C) are also suitable for use as the mixing member 6.

Although a developing device for one-component developer is described above as an example of a developing device in which the developer is circulated in a certain direction, the present invention is not limited to this. The present invention may also be applied to developing devices for two-component developer or magnetic developer under the concept of causing the developer to stay in the mixing section to increase a mixing time. However, even when the present invention is applied to an image-forming system in which an image is formed with developer having high fluidity, such as nonmagnetic, one-component developer, the developer can be sufficiently and uniformly mixed.

Second Embodiment

Figure 14:
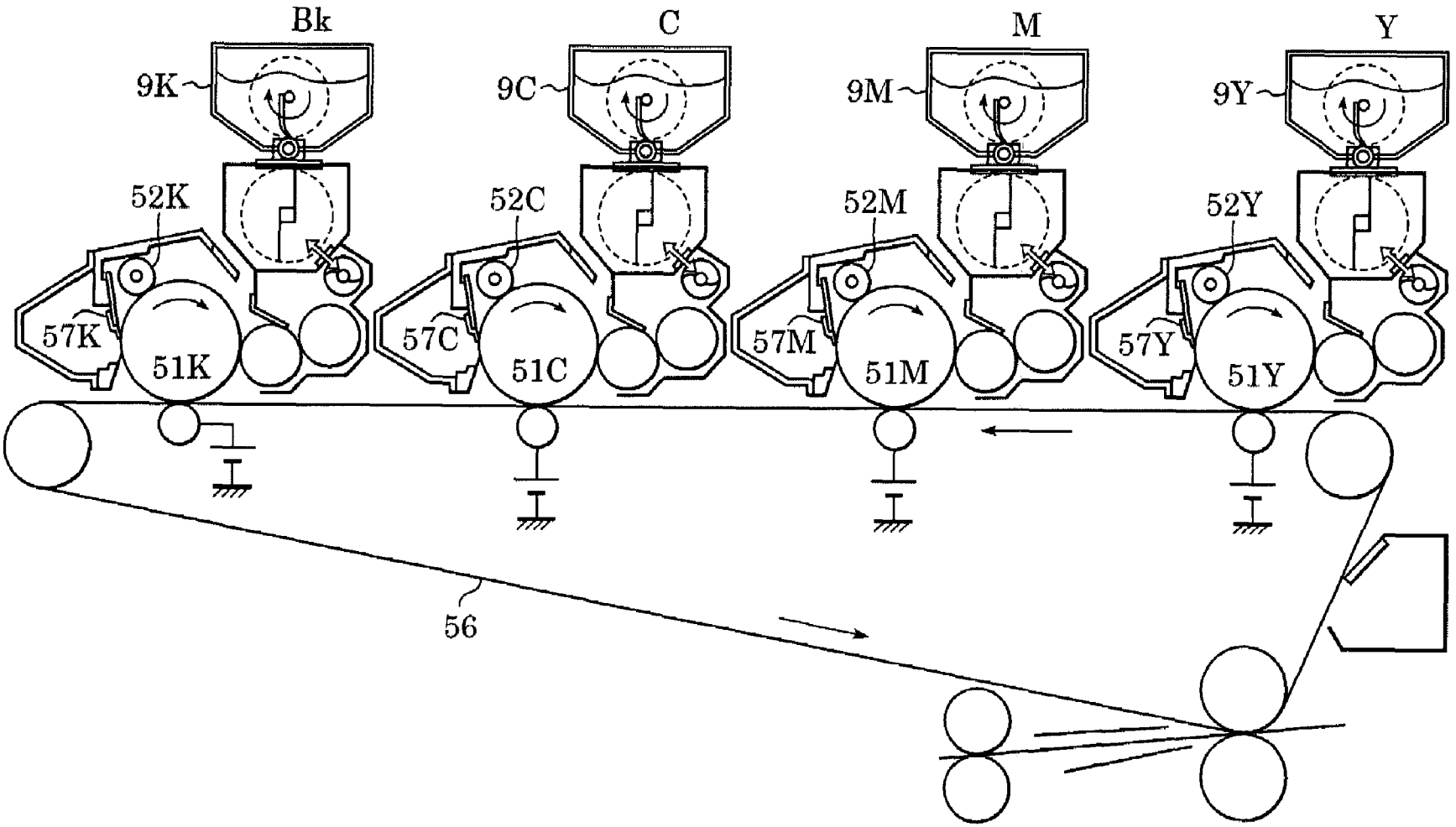
FIG. 14 a schematic diagram showing an electrophotographic image-forming apparatus according to a second embodiment.
Figure 15:
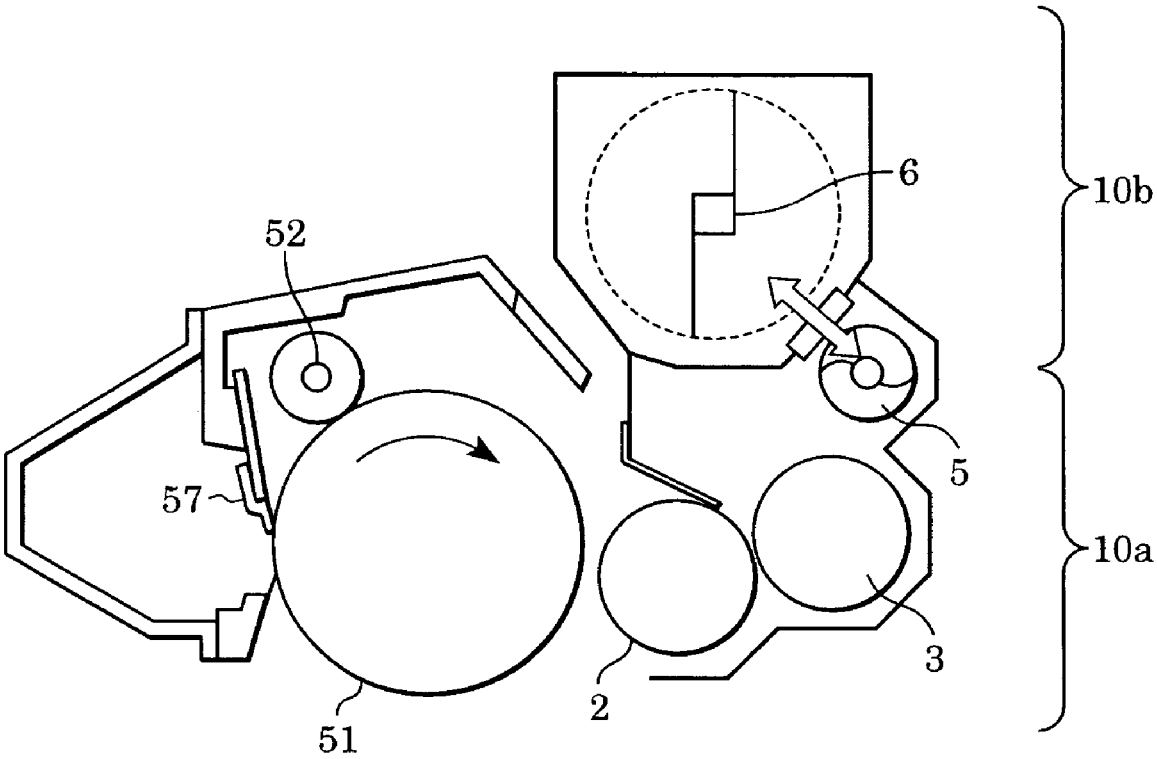
FIG. 15 is a schematic diagram showing a developing device according to the second embodiment.
Figure 16:
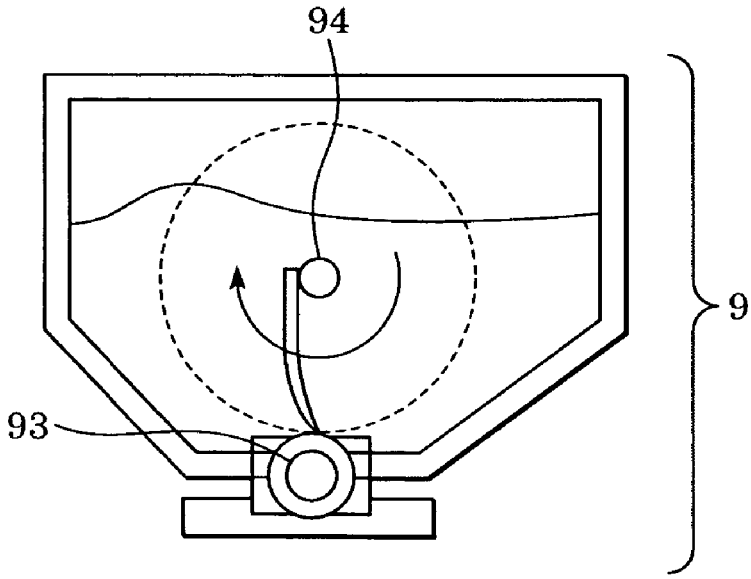
FIG. 16 is a schematic diagram showing a developer hopper according to the second embodiment.

In a second embodiment, the operation according to the first embodiment is applied to a color electrophotographic image-forming apparatus including a plurality of process cartridges. FIG. 14 is a schematic diagram showing a color laser printer using an electrophotographic process, FIG. 15 is a schematic diagram showing a process cartridge, and FIG. 16 is a schematic diagram showing a supply cartridge.

In the present embodiment, developing devices (Y, M, C, and K) having a structure similar to that of the developing device 1 according to the first embodiment are formed integrally with photosensitive drums 51, charging rollers 52, and cleaner units 57 as process cartridges. The process cartridges have a certain life, and are replaceable from the electrophotographic image-forming apparatus. The four process cartridges respectively contain yellow, magenta, cyan, and black developers, and are detachably attached to the main body of the apparatus. In addition, similar to the first embodiment, developer hoppers 9 (Y, M, C, and K) are attached to the main body of the apparatus in a replaceable manner. The structures and operations of the photosensitive drums, the developer rollers, the charging rollers, etc., in the process cartridges are similar to those in the first embodiment, and explanations thereof are thus omitted.

Developer images formed on the surfaces of the photosensitive drums 51 are successively superimposed on an intermediate transferring member 56 in the order of yellow, magenta, cyan, and black process cartridges. Then, the thus obtained developer image is transferred onto a recording medium P conveyed by conveyor rollers. Next, a fixing device (not shown) fixes the developer image on the recording medium P by applying heat and pressure, and the recording medium P on which a full-color image is formed is output.

In full-color electrophotographic image-forming apparatuses, images of multiple colors are superimposed on a single sheet of paper. Therefore, uneven density or fog must be further reduced compared to monochrome apparatuses. The developer-supplying method according to the present embodiment may also be suitably applied to such a full-color electrophotographic image-forming apparatus.

Third Embodiment

Figure 17:
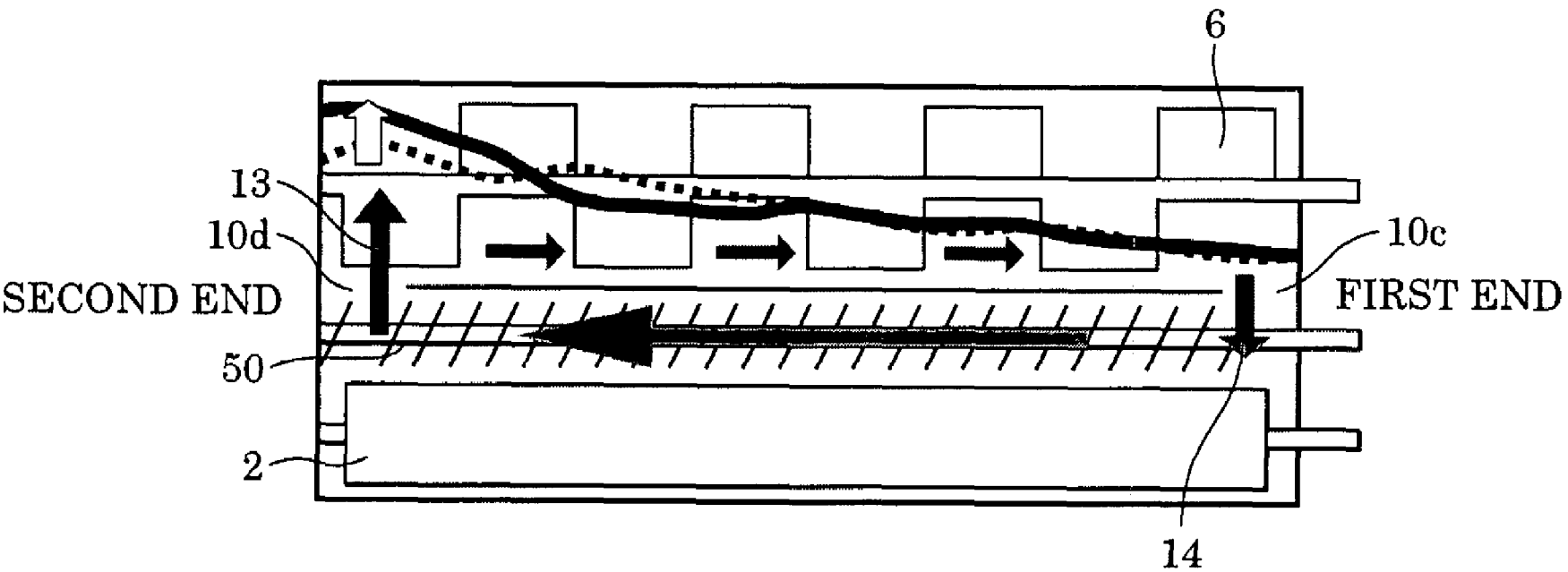
FIG. 17 is a schematic diagram showing a vertical view of a developing device according to a third embodiment.
Figure 18:
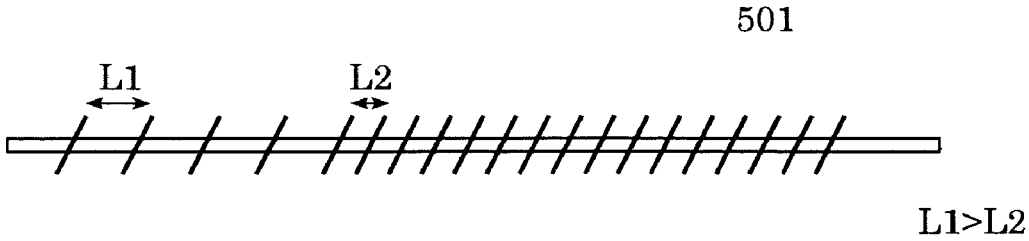
FIG. 18 is a schematic diagram showing a screw of the third embodiment.
Figure 19:
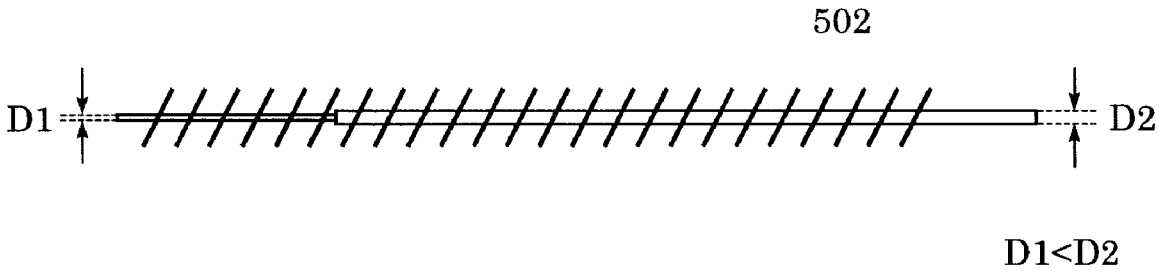
FIG. 19 is a schematic diagram showing a modification of the screw according to the third embodiment.
Figure 20:
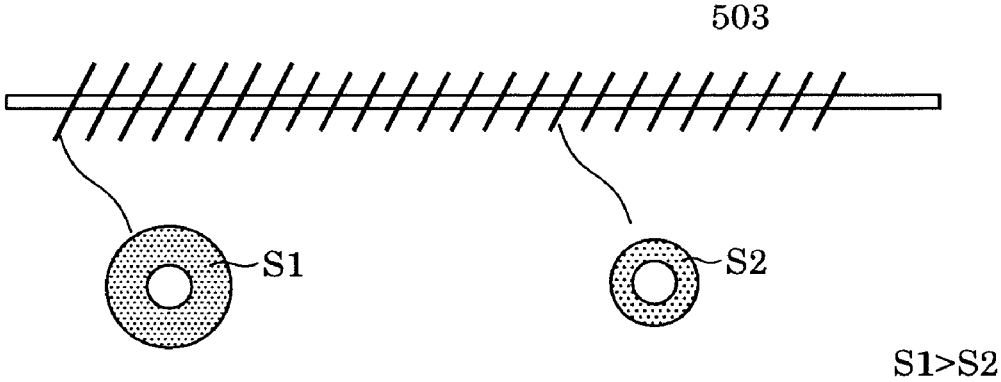
FIG. 20 is a schematic diagram showing another modification of the screw according to the third embodiment.

As shown in FIG. 17, according to a third embodiment, the shape of a screw 50 is different from that of the screw 5 according to the first embodiment. Other structures are similar to those of the first embodiment, and explanations thereof are thus omitted. In the present embodiment, the screw 50 has a shape which varies along the longitudinal direction such that the conveying force at a first end is larger than that at a second end. As an example of a screw which exerts different conveying forces, FIG. 18 shows a screw 501 which includes a helical having different pitches. In this screw 501, the pitch L1 is set larger than the pitch L2. Thus, the conveying force in an area where the pitch is set to L1 is larger than the conveying force in an area where the pitch is set to L2. Alternatively, a screw 502 shown in FIG. 19 in which the diameter of the screw shaft is set such that the diameter D1 is smaller than the diameter D2 may also be used. Also in this screw 502, the conveying force in an area where the diameter is set to D1 is larger than the conveying force in an area where the diameter is set to D2. Alternatively, a screw 503 shown in FIG. 20 which includes a helical blade having different effective areas may also be used. In this screw 503, the effective area S1 is set larger than the effective area S2. Also in this case, the conveying force in an area where the effective area is set to S1 is larger than the conveying force in an area where the effective area is set to S2.

Since the conveying force in an area near the second end is set larger than the conveying force in an area near the first end, the pressure for pushing the developer upward from the developing section 10*a* to the mixing section 10*b* is increased. Accordingly, the developer can smoothly move between the developing section 10*a* and the mixing section 10*b*. In addition, packing of developer at the downstream of the lower screw caused when the developer density is increased, leakage of developer due to local degradation, and fog can be effectively prevented. This structure provides a particularly effective circulation operation in a developer circulation system in which the mixing member which barely exerts a conveying force is provided above the screw. When the conveying force in a region near the second end is increased, an amount of developer 13 which returns to the mixing section 10*b* is increased and an amount of developer 14 fed at the first end becomes smaller than the amount of the developer 13. Therefore, if this structure is applied to the known developing device including two screws with the opposite conveying directions, the developer collects in a region near the first end and the density increases. Accordingly, there is a risk that packing will occur. In addition, if the conveying force in a region near the first end is also increased, the amount of developer supplied to the developing section is also increased. As a result, the circulation rate is increased and there is a risk that the developer will be supplied to the developing section before it is sufficiently mixed. In addition, there is also a risk that the developer will be excessively supplied to the developing section and packing will occur. Thus, if the screw having a shape which varies along the longitudinal direction is used in the known structure in which the developer is circulated using two screws, it becomes difficult to perform stable circulation. In addition, if the developer collects at one end in the known structure including two screws, a developer height at a central area of the mixing section becomes lower than a developer height obtained when the conveying rate is constant in the longitudinal direction. Therefore, if the developer is supplied at a position where the developer height is small, the developer cannot be sufficiently mixed since the developer height is small. As a result, the developer enters the developing section 10*a* while it is not yet mixed enough.

In comparison, in the present embodiment in which the mixing member 6 disposed in the mixing section 10*b* barely exerts a conveying force, when the conveying force is increased at the downstream of the screw 50, the developer height of at the upstream of the mixing member 6 in the mixing section 10*b* simply varies in the vertical direction. Accordingly, since the mixing member 6 which barely exerts a conveying force is used, the developer height is prevented from becoming too small in the mixing section 10*b*. Accordingly, the developer can be sufficiently mixed when it is supplied, and the problems caused when the developer is not mixed enough are avoided.

The screw 50 may also be used in the process cartridges according to the second embodiment.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-250266 filed Aug. 30, 2004 and Japanese Patent Application No. 2005-049029 filed Feb. 24, 2005, which are hereby incorporated by reference herein.

What is claimed is:

1. A developing device used in an electrophotographic image-forming apparatus, comprising:

a developing member for developing an electrostatic latent image formed on an electrophotographic photosensitive member with developer;

a first container section which contains developer to be fed to the developing member;

a second container section positioned above the first container section in a state in which the developing device is installed in the electrophotographic image-forming apparatus, the second container section containing developer supplied from a developer supplier to feed developer to the first container section and being connected to the first container section through a first opening and a second opening;

a first developer-conveying member disposed in the first container section, the first developer-conveying member feeding developer to the developing member and conveying developer from the first opening to the second opening in the first container section;

a second developer-conveying member disposed in the second container section, the second developer-conveying member conveying developer from the second opening to the first opening in the second container section, wherein a developer-conveying ability of the second developer-conveying member to convey developer from the second opening to the first opening in the second container section is weaker than a developer-conveying ability of the first developer-conveying member to convey developer from the first opening to the second opening in the first container section, the ability of the first and second developer-conveying members corresponding to how fast the developer is conveyed between the first and second openings.

2. The developing device according to claim 1, wherein the second developer-conveying member can only level developer horizontally in the second container section.

3. The developing device according to one of claims 1 and 2, wherein the second developer-conveying member levels developer horizontally in the second container section while mixing developer which is conveyed from the first container section to the second container section through the second opening by the first developer-conveying member and developer which is supplied to the second container section by the developer supplier.

4. The developing device according to claim 1, wherein an amount of developer contained in the second container section is at least twice an amount of developer contained in the first container section.

5. The developing device according to claim 1, wherein the second developer-conveying member is one of a member including a rotating shaft and a plurality of blades attached to the rotating shaft, a member including a rotating shaft and a plurality of plastic sheets attached to the rotating shaft, a member including a rotating shaft and a plurality of ribs attached to the rotating member, a member including a wire bent in a rectangular shape, and a member including a rotating wire and a coil spring attached to the wire.

6. The developing device according to claim 1, wherein the developer-conveying ability of the first developer-conveying member in an area near the second opening is stronger than the developer-conveying ability of the first developer-conveying member in an area near the first opening.

7. A process cartridge comprising the developing device according to claim 1 and the electrophotographic photosensitive member.

8. An electrophotographic image-forming apparatus comprising the process cartridge according to claim 7, the process cartridge being detachably attached in the electrophotographic image-forming apparatus.

9. A developing device used in an electrophotographic image-forming apparatus, comprising:

a developing member configured to develop an electrostatic latent image formed on an electrophotographic photosensitive member with developer;

a first container section which contains developer to be fed to the developing member;

a second container section positioned above the first container section in a state in which the developing device is installed in the electrophotographic image-forming apparatus, the second container section containing developer supplied from a developer supplier to feed developer to the first container section and being connected to the first container section through a first opening and a second opening;

a first developer-conveying member being a screw and disposed in the first container section, the first developer-conveying member feeding developer to the developing member and conveying developer from the first opening to the second opening in the first container section;

a second developer-conveying member not being a screw and being disposed in the second container section, the second developer-conveying member conveying developer from the second opening to the first opening in the second container section, wherein a developer-conveying force of the second developer-conveying member which conveys developer from the second opening to the first opening in the second container section is weaker than a developer-conveying force of the first developer-conveying member which conveys developer from the first opening to the second opening in the first container section.

10. The developing device according to claim 9, wherein the developer-conveying force of the second developer-conveying member can only level developer horizontally in the second container section.

11. The developing device according to claim 10, wherein the second developer-conveying member levels developer horizontally in the second container section while mixing developer that is conveyed from the first container section to the second container section through the second opening by the first developer-conveying member and developer that is supplied to the second container section by the developer supplier.

12. The developing device according to claim 9, wherein an amount of developer contained in the second container section is at least twice an amount of developer contained in the first container section.

13. The developing device according to claim 9, wherein the second developer-conveying member is one of a member including a rotating shaft and a plurality of blades attached to the rotating shaft, a member including a rotating shaft and a plurality of plastic sheets attached to the rotating shaft, a member including a rotating shaft and a plurality of ribs attached to the rotating member, a member including a wire bent in a rectangular shape, and a member including a rotating wire and a coil spring attached to the wire.

14. The developing device according to claim 9, wherein the developer-conveying force of the first developer-conveying member in an area near the second opening is stronger than the developer-conveying force of the first developer-conveying member in an area near the first opening.

15. A process cartridge comprising the developing device according to claim 9 and the electrophotographic photosensitive member.

16. An electrophotographic image-forming apparatus comprising the process cartridge according to claim 15, the process cartridge being detachably attached in the electrophotographic image-forming apparatus.

17. A developing device used in an electrophotographic image-forming apparatus, comprising:

a developing member configured to develop an electrostatic latent image formed on an electrophotographic photosensitive member with developer;

a first container section which contains developer to be fed to the developing member;

a second container section positioned above the first container section in a state in which the developing device is installed in the electrophotographic image-forming apparatus, the second container section containing developer supplied from a developer supplier to feed developer to the first container section and being connected to the first container section through a first opening and a second opening;

a screw member disposed in the first container section, the screw member feeding developer to the developing member and conveying developer from the first opening to the second opening in the first container section;

a blade member disposed in the second container section, the blade member conveying developer from the second opening to the first opening in the second container section, wherein a developer-conveying force of the blade member which conveys developer from the second opening to the first opening in the second container section is weaker than a developer-conveying force of the screw member which conveys developer from the first opening to the second opening in the first container section.

18. The developing device according to claim 17, wherein the developer-conveying force of the second developer-conveying member can only level developer horizontally in the second container section.

19. The developing device according to claims 18, wherein the second developer-conveying member levels developer horizontally in the second container section while mixing developer that is conveyed from the first container section to the second container section through the second opening by the first developer-conveying member and developer that is supplied to the second container section by the developer supplier.

20. The developing device according to claim 17, wherein an amount of developer contained in the second container section is at least twice an amount of developer contained in the first container section.

21. The developing device according to claim 17, wherein the second developer-conveying member is one of a member including a rotating shaft and a plurality of blades attached to the rotating shaft, a member including a rotating shaft and a plurality of plastic sheets attached to the rotating shaft, a member including a rotating shaft and a plurality of ribs attached to the rotating member, a member including a wire bent in a rectangular shape, and a member including a rotating wire and a coil spring attached to the wire.

22. The developing device according to claim 17, wherein the developer-conveying force of the first developer-conveying member in an area near the second opening is stronger than the developer-conveying force of the first developer-conveying member in an area near the first opening.

23. A process cartridge comprising the developing device according to claim 17 and the electrophotographic photosensitive member.

24. An electrophotographic image-forming apparatus comprising the process cartridge according to claim 23, the process cartridge being detachably attached in the electrophotographic image-forming apparatus.

* * * * *